United States Patent [19]

Namiki

[11] 4,136,613

[45] Jan. 30, 1979

[54] FIXING APPARATUS FOR ELECTROSTATIC PHOTOGRAPHY

[75] Inventor: Ryoichi Namiki, Tokyo, Japan

[73] Assignee: Ricoh Company, Ltd., Tokyo, Japan

[21] Appl. No.: 679,290

[22] Filed: Apr. 22, 1976

[30] Foreign Application Priority Data

Apr. 30, 1975 [JP] Japan ..... 50/52145

[51] Int. Cl.[2] ..... B05C 11/00

[52] U.S. Cl. ..... 118/60; 432/60

[58] Field of Search ..... 118/60, 70, 104, 203, 118/114, 260; 432/60, 228, 59; 29/132

[56] References Cited

U.S. PATENT DOCUMENTS

| | | | |
|---|---|---|---|
| 535,393 | 3/1895 | Norton | 118/60 |
| 2,398,844 | 4/1946 | Muggleton et al. | 118/203 X |
| 2,770,215 | 11/1956 | Knight | 118/260 |
| 3,751,216 | 8/1973 | Gregory | 432/60 X |
| 3,810,776 | 5/1974 | Banks et al. | 118/114 X |
| 3,848,305 | 11/1974 | Jachimiak | 29/132 |
| 3,874,843 | 4/1975 | Fujimoto | 432/60 |
| 3,880,577 | 4/1975 | Tomono et al. | 432/228 |
| 4,011,353 | 3/1977 | Okamoto et al. | 118/60 X |

*Primary Examiner*—Dorsey Newton
*Attorney, Agent, or Firm*—Frank J. Jordan

[57] ABSTRACT

A copy sheet is fed between a heated fixing roller and a nip roller to fix a toner image to the sheet. An applicator applies an offset preventing liquid to a transfer roller which transfers the liquid to the fixing roller. A spring arrangement presses the applicator against the transfer roller and another spring arrangement presses the transfer roller against the fixing roller in such a manner that the transfer roller is normally held against rotation and is caused to rotate when the liquid thickness on the fixing roller drops below a predetermined value at which the coefficient of friction between the transfer roller and the fixing roller becomes greater than the ratio of the tangential to the normal forces therebetween. The transfer roller through rotation applies the liquid to the fixing roller to increase the liquid thickness thereon. The spring forces are selected so that the normal force between the transfer roller and fixing roller is greater than the normal force between the transfer roller and applicator.

6 Claims, 6 Drawing Figures

FIXING APPARATUS FOR ELECTROSTATIC PHOTOGRAPHY

BACKGROUND OF THE INVENTION

The present invention relates to a fixing apparatus for dry electrostatic photography.

Thermal fixing apparatus comprising a thermal fixing roller to fix a toner image to a copy sheet is known in which an offset preventing liquid which is typically a silicone oil is applied to the surface of the fixing roller. In one known form a felt wick has one end immersed in a container of the oil and the other end contacting the fixing roller. In another known form an applicator roller contacts the fixing roller and is partly immersed in a container of the oil. A problem common to both of the systems is that the amount of liquid applied to the fixing roller cannot be readily controlled. After a period of operation the amount of liquid usually becomes excessive and contaminates the copy sheet and/or smears the toner image.

An improvement to such a fixing apparatus comprises a transfer roller, an applicator wick and a spring pressing the wick into contact with the transfer roller and the transfer roller into contact with the fixing roller. The spring force is selected in such a manner that the transfer roller is rotated by the fixing roller only when the thickness of liquid on the fixing roller drops below a predetermined value and thereby the coefficient of friction between the transfer roller and the fixing roller increases above a corresponding predetermined value to apply more liquid to the fixing roller.

A drawback to such a system is that it is not operable in a case in which the fixing roller is formed of a hard material such as TEFLON (TRADEMARK). The reason is that the coefficient of friction between the transfer roller and the fixing roller is always lower than that between the transfer roller and the wick, and the transfer roller is therefore not rotatable by the fixing roller. Increasing the spring force, although increasing the normal force between the transfer roller and the fixing roller also increases the normal force between the transfer roller and the wick, and is not effective in rendering the transfer roller rotatable. Reducing the spring force to a level close to zero renders the transfer roller rotatable but in an unstable manner which results in excessive liquid being applied to the fixing roller.

SUMMARY OF THE INVENTION

It is therefore an object of the present invention to provide a thermal fixing apparatus for electrostatic photography in which a proper amount of liquid is applied to a fixing roller in a controlled manner.

It is another object of the present invention to provide a fixing apparatus comprising springs pressing a transfer roller into contact with a fixing roller and a liquid applicator into contact with the transfer roller in such a manner that the transfer roller is rotatable by the fixing roller when the coefficient of friction between the transfer roller and the fixing roller increases above a predetermined value to apply more liquid to the fixing roller.

It is a further object of the present invention to provide a fixing apparatus in which materials of a fixing roller, a transfer roller and a liquid applicator are selected in such a manner that a surface energy of the fixing roller is smaller than that of the transfer roller which is smaller than that of the liquid applicator.

It is a still further object of the present invention to provide a fixing apparatus in which materials of a fixing roller, a transfer roller and a liquid applicator are selected in such a manner that a hardness of the fixing roller is greater than that of the transfer roller which is greater than that of the liquid applicator.

Other objects, in addition to the foregoing, are attained in the embodiments described in the following description and illustrated in the accompanying drawings.

DESCRIPTION OF THE PREFERRED EMBODIMENTS

Figure 1:
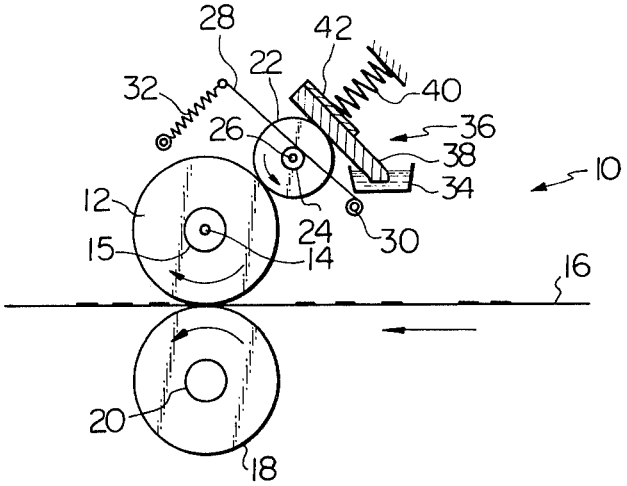
FIG. 1 is a schematic view of a first embodiment of a thermal fixing apparatus according to the present invention.

While the fixing apparatus of the invention is susceptible of numerous physical embodiments, depending upon the environment and requirements of use, substantial numbers of the herein shown and described embodiments have been made, tested and used, and all have performed in an eminently satisfactory manner.

Throughout the various figures of the drawing like reference numerals designate identical elements.

In FIG. 1 a thermal fixing apparatus 10 for dry electrostatic photography comprises a thermal fixing roller 12 which is rotatable about a fixed axis 14. A motor (not shown) drives the fixing roller 12 for clockwise rotation. A heater 15 is operatively disposed inside the fixing roller 12. A copy sheet 16 carrying a developed toner image is movable leftward between the fixing roller 12 and a nip roller 18 which is urged upward toward pressing contact with the fixing roller 12 by biasing means which are not shown. A heater 20 is mounted inside the nip roller 18. The rollers 12 and 18 thermally fix the toner image to the copy sheet 16 as the sheet 16 pressingly passes therebetween.

A transfer roller 22 is supported for rotation by a coaxial shaft 24 about an axis 26 which is parallel to the axis 14. The shaft 24 and transfer roller 22 are, however, movable toward and away from the axis 14.

A lever 28 is pivotal about a fixed fulcrum 30 and is urged into pressing engagement with the shaft 24 by a tension spring 32 to urge the transfer roller 22 into pressing engagement with the fixing roller 12.

An offset preventing liquid such as silicone oil is contained in a reservoir 34. An applicator 36 comprises a wick 38 having one end immersed in the liquid in the reservoir 34 and the other end portion pressed into contact with the transfer roller 22 by means of a compression spring 40 and a spring seat 42.

The coefficient of friction between the wick 38 and transfer roller 22 is substantially constant so that there is a constant friction force between the wick 38 and transfer roller 22. The coefficient of friction between the transfer roller 22 and fixing roller 12, however, is variable depending on the thickness of liquid on the surface of the fixing roller 12.

When a sufficient amount of liquid is on the fixing roller 12, the coefficient of friction between the rollers 12 and 22 is below a predetermined value. The forces of the springs 32 and 40 are selected such that the coefficient of friction between the rollers 12 and 22 under these conditions is lower than the ratio of the tangential to the normal forces between the rollers 12 and 22. The transfer roller 22 is thereby held against rotation by the friction force between the transfer roller 22 and the wick 38.

As the liquid on the fixing roller 12 is consumed through operation of the apparatus 10, the coefficient of friction between the rollers 12 and 22 increases above the predetermined value. In this case, the coefficient of friction between the rollers 12 and 22 is greater than the ratio of the tangential to the normal forces between the rollers 12 and 22, and the transfer roller 22 is driven for rotation by the fixing roller 12 against the friction force between the transfer roller 22 and wick 38. The torque applied by the motor to the fixing roller 12 must, of course, be sufficient to overcome the friction force. Rotation of the transfer roller 22 causes more liquid to be applied to the fixing roller 12 thereby reducing the coefficient of friction between the rollers 12 and 22 below the predetermined value. When this occurs, the transfer roller 22 is again held against rotation. This operation is automatically repeated so as to maintain the proper thickness of liquid on the surface of the fixing roller 12.

It will be realized that the prior art apparatus which does not comprise the spring 32 is not operable when the fixing roller 12 is formed of a material such as TEFLON (TRADEMARK) which has a very low coefficient of friction, specifically lower than that of the wick 38 which is made of felt or the like. The coefficient of friction between the rollers 12 and 22 would always be lower than that between the transfer roller 22 and the wick 38 so that the transfer roller 22 could not rotate under any conditions. With the addition of the spring 32, however, the normal force between the rollers 12 and 22 is made greater than that between the transfer roller 22 and wick 38 by an amount sufficient to render the transfer roller 22 rotatable when the coefficient of friction between the rollers 12 and 22 exceeds the predetermined value.

The surface energy of the wick 38 is preferably greater than that of the transfer roller 22 which is preferably greater than that of the fixing roller 12. By this expedient, contaminating particles on the fixing roller 12 such as particles of toner will be transferred to the transfer roller 22 and deposited on the wick 38 for easy removal. The surface energies of the rollers 12 and 22 are also preferably made small to avoid contamination by the liquid.

The rollers 12 and 22 may be formed of a fluoric or cilicic resin which has low surface energy to minimize transfer of toner particles to the rollers 12 and 22. The fixing roller 12 is preferably formed of a tetrafluoric resin such as TEFLON (TRADEMARK) or a copolymer of a tetrafluoric resin. The transfer roller 22 may be formed of a silicone rubber or a fluoric silicone rubber. The rubber may be preferably mixed with a filler such as silica, red iron oxide, zinc oxide, powdered glass, powdered metal or fluoric resin so that the surface energy of the transfer roller 22 is greater than that of the fixing roller 12. The wick 38 may be formed of felt, cloth, ceramic fibers or the like. It is also preferable that the hardness of the fixing roller 12 be greater than that of the transfer roller 22 which is greater than that of the wick 38.

Figure 2:
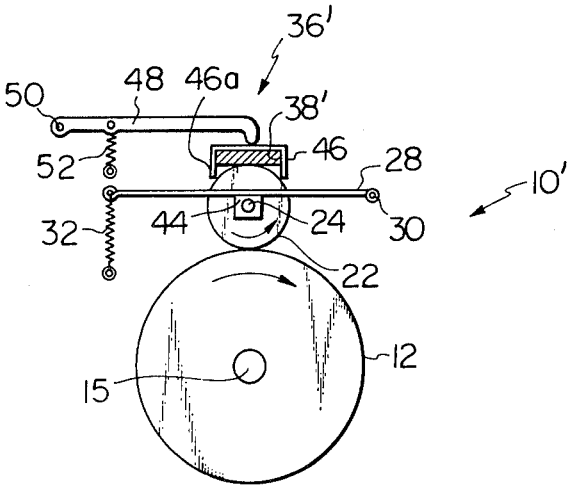
FIG. 2 is a schematic view illustrating a modification of the first embodiment shown in FIG. 1.

FIG. 2 shows a modification of the apparatus 10 which is designated as 10'. Identical elements are designated be the same reference numerals and similar elements are designated by the same reference numerals suffixed by an apostrophe. In FIG. 2, a block 44 connects the lever 28 to the shaft 24 of the transfer roller 22. The wick 38' of the applicator 36' is provided inside a liquid leveller 46 which serves to support the wick 38' to protect the same from contamination by dust and prevent excessive application of liquid to the transfer roller 22. An edge **46*a* of the leveller 46 is either slightly spaced from the transfer roller 22 or actually contacts the transfer roller 22. The leveller 46** may be formed of a metal or plastic coated with a material having relatively low surface energy such as fluoric resin or silicon resin.

A lever 48 is pivotal about a fixed fulcrum 50 and urged by a tension spring 52 to press the leveller 46 and thereby the wick 38' against the transfer roller 22. This arrangement serves the same function as the spring 40 and spring seat 42 shown in FIG. 1. It is to be noted that the wick 38' may be supplied with the liquid by a suitable means or the wick 38' per se may contain the liquid.

Figure 3:
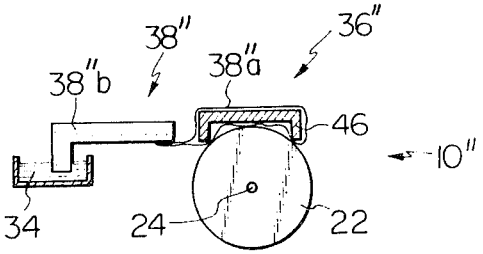
FIG. 3 is a schematic view illustrating a second modification of the first embodiment shown in FIG. 1.

FIG. 3 illustrates another modification of the invention designated as a fixing apparatus 10''. In this form the wick 38'' of the applicator 36'' is provided in two sections, a bag section **38*a*'' surrounding the leveller 46 and contacting the transfer roller 22 and a connecting section 38*b*'' connecting the bag section 38*a*'' to the reservoir 34**.

Figure 4:
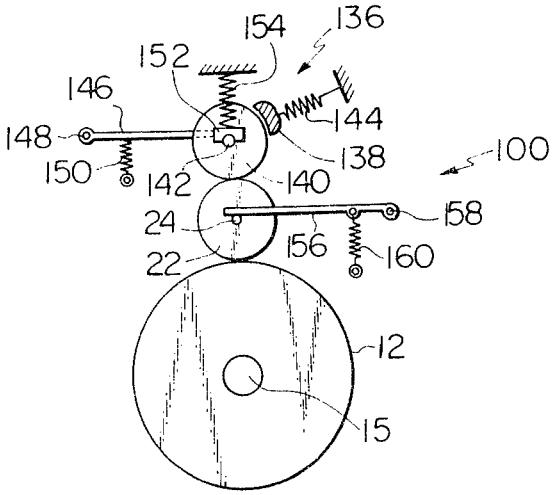
FIG.4 is a schematic view of a second embodiment of the invention.

FIG. 4 illustrates a fixing apparatus 100 which is a second embodiment of the invention. In this embodiment, an applicator 136 comprises an applicator roller 140 integral with a shaft 142. A compression spring 144 presses a wick 138 against the applicator roller 140. The wick 138 may be supplied with the liquid by a suitable means or the wick 138 per se may contain the liquid. A lever 146 has a fixed fulcrum 148 and is urged by a tension spring 150 to engage with the shaft 142 and press the applicator roller 140 against the transfer roller 22. A friction member 152 is pressed against the shaft 142 by a compression spring 154 to provide frictional resistance thereto. A slightly modified lever 156 is urged about a fixed fulcrum 158 by a tension spring 160 to urge the rollers 22 and 12 together. The applicator roller 140 is driven for rotation by the transfer roller 22 when the coefficient of friction therebetween exceeds a predetermined value.

Figure 5:
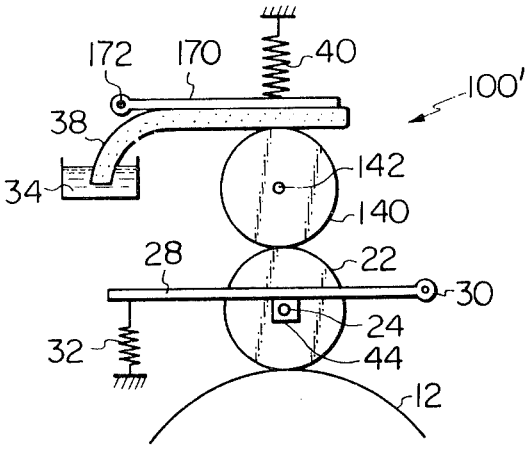
FIG. 5 is a schematic view illustrating a modification of the second embodiment shown in FIG. 4.

FIG. 5 shows a modified fixing apparatus 100' which is identical to the apparatus 10 except that the applicator roller 140 is disposed between the wick 38 and the transfer roller 22 and the force of the spring 40 is applied to the wick 38 by means of a lever 170 pivotal about a fixed fulcrum 172 rather than by the spring seat 42 shown in FIG. 1.

Figure 6:
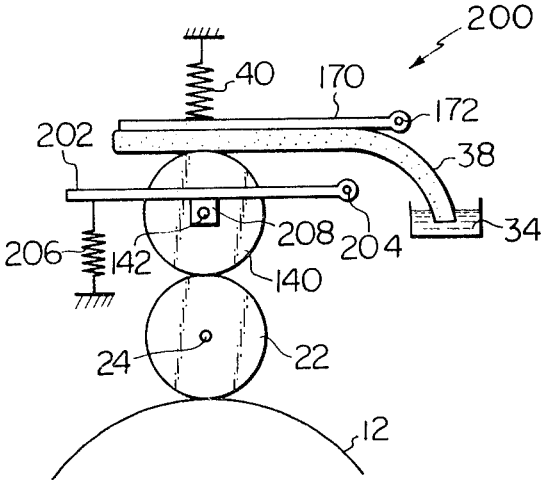
FIG. 6 is a schematic view of a third embodiment of the invention.

FIG. 6 illustrates a fixing apparatus 200 which constitutes a third embodiment of the present invention. The apparatus 200 is essentially similar to the embodiment of FIG. 5 except that a lever 202 pivotal about a fixed fulcrum 204 is urged by a tension spring 206 to engage with the shaft 142 of the roller 140 through a block 208. Whereas in the embodiment of FIG. 5 a spring force is applied to the shaft 24 of the transfer roller 22, in the embodiment of FIG. 6 the spring force is applied to the shaft 142 of the applicator roller 140.

Various modifications are possible within the scope of the invention. The leveller 46 is preferably detachable to facilitate removal of toner particles trapped thereby. The applicator roller 140 may be immersed in liquid rather than contacting the wick 138 in FIG. 4. Means may be provided to selectively release the friction forces between the shaft 142 and the friction member 152 and the applicator roller 140 and the wick 138 if desired. Also, more than one applicator roller 140 may be provided.

What is claimed is:

1. An electrophotographic apparatus comprising:

a rotating fixing member;

a transfer roller;

an applicator roller having a shaft coaxial therewith and pressed into contact with the transfer roller;

an applicator member pressed into contact with the applicator roller;

a friction member being pressed against the shaft by a compression spring to provide a frictional resistance thereto;

first biasing means for pressing the transfer roller and the fixing member together with a force $F_1$; and second biasing means for pressing the transfer roller and the applicator roller together with a force $F_2$, the second biasing means comprising a lever pivotal about a fixed fulcrum and a spring urging the lever into pressing engagement with the shaft, the force $F_1$ being greater than the force $F_2$, the forces $F_1$ and $F_2$ being selected so that the transfer roller is driven for rotation by the fixing member against the friction force between the transfer roller and the applicator roller when the coefficient of friction between the transfer roller and the fixing member is above a predetermined value and the transfer roller is held against rotation by the friction force between the transfer roller and the applicator roller when the coefficient of friction between the transfer roller and the fixing member is below the predetermined value, the surface energy of the fixing member being smaller than the surface energy of the transfer roller which is smaller than the surface energy of the applicator roller.

2. An apparatus according to claim 1, in which the hardness of the fixing member is greater than that of the transfer roller which is greater than that of the applicator roller.

3. An apparatus according to claim 1, in which the fixing member is a roller.

4. An apparatus according to claim 1, in which the first biasing means comprises a first spring and the second biasing means comprises a second spring.

5. An apparatus according to claim 1, in which the transfer roller comprises a shaft coaxial therewith, the first biasing means comprising a lever pivotal about a fixed fulcrum and a spring urging the lever into pressing engagement with the shaft.

6. An electrophotographic apparatus comprising:

a rotating fixing member;

a transfer roller;

a liquid applicator means comprising a wick being pressed into contact with the transfer roller, a liquid reservoir communicating with the wick, a liquid leveller supporting the wick, the wick comprising a bag section surrounding the leveller and contacting the transfer roller and a connecting section connecting the bag section to the liquid reservoir;

first biasing means for pressing the transfer roller and the fixing member together with a force $F_1$; and second biasing means for pressing the transfer roller and the applicator means together with a force $F_2$ such that the bag section is in contact with the transfer roller, the force $F_1$ being greater than the force $F_2$, the forces $F_1$ and $F_2$ being selected so that the transfer roller is driven for rotation by the fixing member against the friction force between the transfer roller and the applicator means when the coefficient of friction between the transfer roller and the fixing member is above a predetermined value and the transfer roller is held against rotation by the friction force between the transfer roller and the applicator means when the coefficient of friction between the transfer roller and the fixing member is below the predetermined value, the surface energy of the fixing member being smaller than the surface energy of the transfer roller which is smaller than the surface energy of the applicator means.

* * * * *